US007874029B2

(12) United States Patent
Alston

(10) Patent No.: US 7,874,029 B2
(45) Date of Patent: Jan. 25, 2011

(54) RETRACTABLE TOE TENT DEVICE AND METHOD OF USING SAME

(75) Inventor: Robert Alston, P.O. Box 512, Hamilton, GA (US) 31811

(73) Assignee: Robert Alston, Hamilton, GA (US)

( * ) Notice: Subject to any disclaimer, the term of this patent is extended or adjusted under 35 U.S.C. 154(b) by 60 days.

(21) Appl. No.: 11/846,171

(22) Filed: Aug. 28, 2007

(65) Prior Publication Data

US 2009/0056019 A1 Mar. 5, 2009

(51) Int. Cl.
*A47C 21/02* (2006.01)

(52) U.S. Cl. ..... 5/505.1; 5/503.1; 5/504.1

(58) Field of Classification Search ..... 5/498, 5/503.1, 504.1, 505.1, 658
See application file for complete search history.

(56) References Cited

U.S. PATENT DOCUMENTS

| | | | | |
|---|---|---|---|---|
| 2,106,834 | A | 9/1933 | Ewald | |
| 2,598,295 | A | 5/1952 | Pelton | |
| 2,602,171 | A | 7/1952 | Good | |
| 2,611,139 | A * | 9/1952 | Ecklund | 5/505.1 |
| 2,618,789 | A | 11/1952 | Kane | |
| 2,642,589 | A * | 6/1953 | Cobb | 5/505.1 |
| 3,196,468 | A | 7/1965 | McWilliams | |
| 3,366,381 | A | 1/1968 | Ross | |
| 3,513,952 | A | 5/1970 | Warner, Jr. | |
| 4,214,327 | A | 7/1980 | Smith | |
| 4,975,997 | A | 12/1990 | Misiura et al. | |
| 5,329,658 | A | 7/1994 | Fontenot et al. | |
| 5,881,406 | A | 3/1999 | Cobb | |
| 6,026,543 | A | 2/2000 | Chen | |
| 6,128,806 | A | 10/2000 | Shou-Mao | |
| 6,134,731 | A * | 10/2000 | Thom et al. | 5/662 |
| 6,240,581 | B1 * | 6/2001 | Pender | 5/505.1 |
| 6,338,400 | B1 | 1/2002 | Wu | |
| 6,662,916 | B2 | 12/2003 | Tiramani et al. | |
| 6,796,446 | B2 | 9/2004 | Segall et al. | |
| 6,895,615 | B2 | 5/2005 | Dilascio | |
| 6,901,616 | B1 | 6/2005 | Warrington et al. | |
| 2004/0231939 | A1 | 11/2004 | Miyoshi | |

FOREIGN PATENT DOCUMENTS

| | | |
|---|---|---|
| WO | WO 2006/119267 A2 | 11/2006 |

* cited by examiner

*Primary Examiner*—Shane Bomar
*Assistant Examiner*—Gilbert Y Lee
(74) *Attorney, Agent, or Firm*—J. Mark Bledsoe; Lanier Ford Shaver & Payne, P.C.

(57) ABSTRACT

A retractable toe tent device is provided to elevate the covers at the foot of the bed so that a person may sleep comfortably without the weight of the covers on their feet, thereby preventing pain or discomfort in their toes, feet, ankles, or knees. The device is comprised of a base and a telescoping support which can be raised while in use, or lowered while not in use.

9 Claims, 4 Drawing Sheets

RETRACTABLE TOE TENT DEVICE AND METHOD OF USING SAME

FIELD OF THE DISCLOSURE

This disclosure generally relates to the field of bedding accessories. In particular, the present disclosure relates to a device with a retractable handle at the foot of a bed for supporting the covers in an elevated position.

BACKGROUND OF THE DISCLOSURE

Many people suffer from discomfort in their toes, feet, ankles, and knees due to the weight of the covers pressing down on their feet while they sleep. This is especially true for people who sleep on their backs with their toes in an upright position. Such discomfort can lead to loss of sleep which can affect the overall quality of life for an individual.

Accordingly, there is a need for a device that is sturdy, lightweight, and portable capable of suspending covers over an individual's toes while lying in bed. This device should be barely noticeable when not in use, and should be easy to install and operate. The present disclosure exhibits each of these advantages.

SUMMARY OF THE DISCLOSURE

The present disclosure is directed to a retractable toe tent device that elevates the covers at the foot of the bed so that people may sleep comfortably without the weight of the covers causing pain or discomfort in their toes, feet, ankles, or knees. The present device provides a supporting mechanism that is retractable so that the height of the covers can be quickly adjusted. Also, the retractable feature allows the device to be easily concealed without being removed from the bed when it is not in use. The present disclosure also provides a device that is sturdy enough to support the weight of multiple sheets, covers, and blankets, yet it is also lightweight and portable so that it may be easily removed and transported while traveling.

Still further, the present disclosure may be installed and operated by one person without assistance. Also, while in use, the present device will not come into contact with the user such that he or she may move around freely and comfortably on the bed without colliding with the device.

Additional objects and advantages of the disclosure are set forth in, or will be apparent to those of ordinary skill in the art form, the detailed description as follows. Also, it should be further appreciated that modifications and variations to the specifically illustrated and discussed features and materials hereof may be practiced in various embodiments and uses of this disclosure without departing from the spirit and scope thereof, by virtue of present reference thereto. Such variations may include, but are not limited to, substitutions of the equivalent means, features, and materials for those shown or discussed, and the functional or positional reversal of various parts, features, method steps, or the like.

These and other features, aspects, and advantages of the present disclosures will become better understood with reference to the following descriptions and the appended claims. The accompanying drawings, which are incorporated in and constitute a part of this specification, illustrate an embodiment of the disclosure, and, together with the descriptions, serve to explain the principles of the disclosure.

DETAILED DESCRIPTION OF THE DISCLOSURE

Reference will now be made in detail to a presently preferred embodiment of the disclosure, examples of which are fully represented in the accompanying drawings. Such examples are provided by way of explanation of the disclosure, not limitation thereof. In fact, it will be apparent to those skilled in the art various modifications and variations can be made in the present disclosure without departing from the spirit and scope thereof. For instance, features illustrated or described as part of one embodiment may be used on another embodiment to yield still a further embodiment. Still farther, variations and selections of materials and/or characteristics may be practiced to satisfy particular desired criteria. Thus, it is intended that the present disclosure cover such modifications and variations as come within the scope of the present features and their equivalents.

Figure 1:
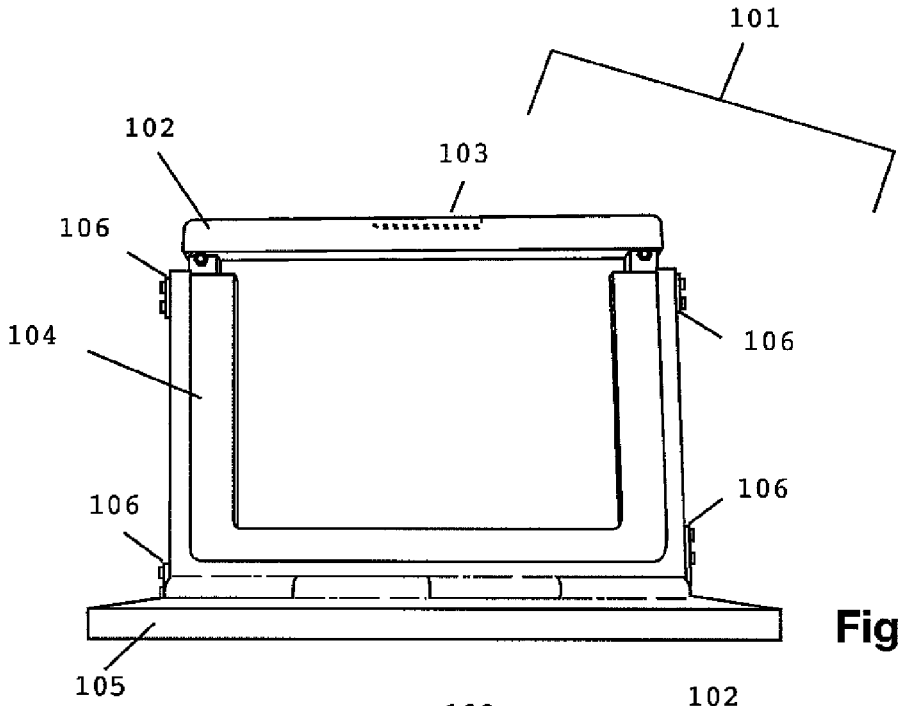
FIG. 1 is a front plan view of an exemplary toe tent device in a lowered position.

FIG. 1 shows a front plan view of an exemplary toe tent device 101 in the lowered position. The toe tent device 101 includes a telescoping support handle 102 equipped with a depressible button 103 for adjusting the height of the support handle 102. In one embodiment, described more fully in FIG. 7, the depressible button 103 is recessed into the support handle 102 so that the weight of the bed covers do not depress the button 103 while it is in use. A U-shaped support member 104 is pivotally attached to the base 105 so the toe tent device 101 can be folded together. In one embodiment, the device 101 has rounded corners in order to ensure smooth interaction with the bed and bed covers.

Figure 2:
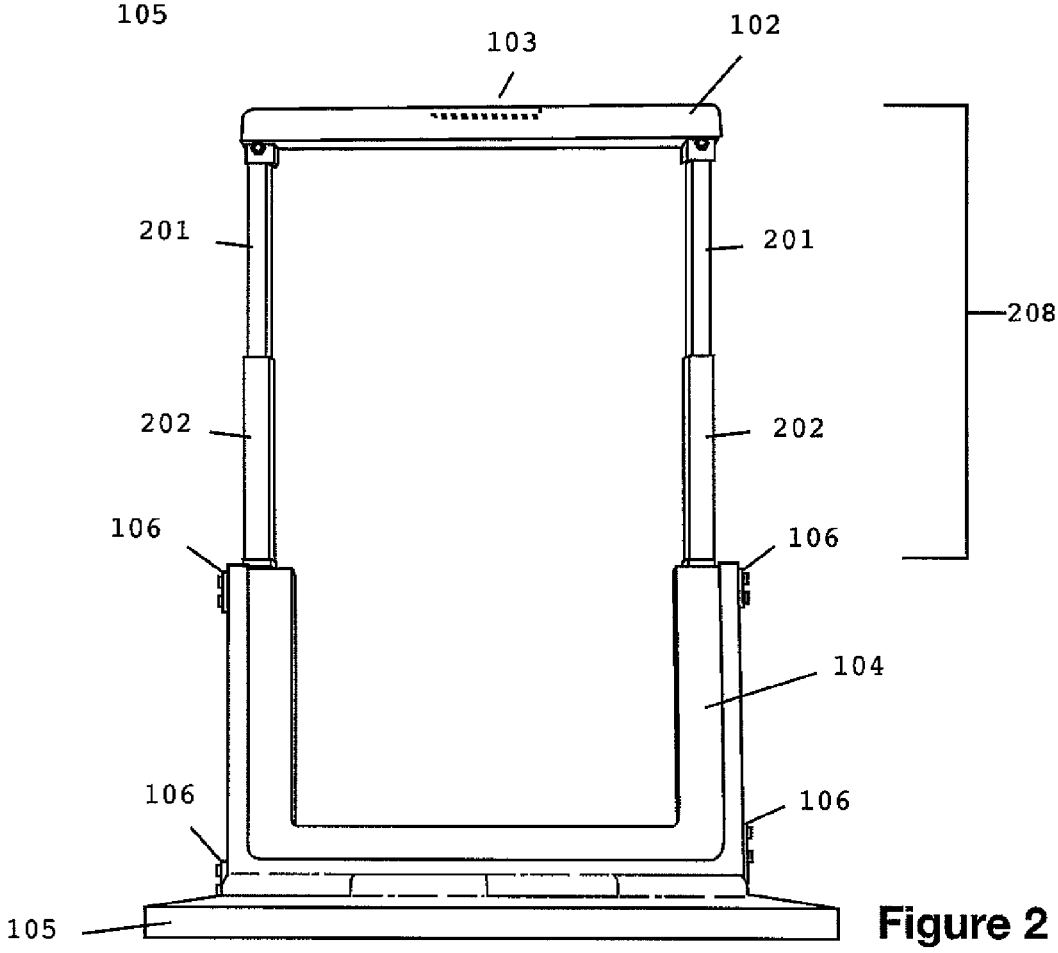
FIG. 2 is a front plan view of an exemplary toe tent device in a raised position.

FIG. 2 shows a front plan view of an exemplary toe tent device 101 in the raised position. The support handle 102 is attached to the top of the upper tubes 201, which are adjustably locked inside the top of the corresponding middle tubes 202. The bottom of the middle tubes 202 are adjustably locked into place inside the top of the corresponding lower tubes 301 (see FIG. 3), which are attached by brackets 106 to the U-shaped support member 104. In an alternative embodiment, the lower tubes 301 may be pivotally attached directly to the base 105 to eliminate the need for the U-shaped support member 104. The U-shaped support member 104 is included in the preferred embodiment in order to add strength and rigidity to the device. When the button 103 is depressed, the upper tubes 201 become unlocked from the middle tubes 202, which become unlocked from the lower tubes 301 (see FIG. 3), and the support handle 102 is able to move up and down freely. Collectively, the handle, upper tubes, middle tubes, and lower tubes form a telescoping support 208 similar to a rolling luggage handle. In other embodiments, the telescoping support 208 may take the form of any of those disclosed in U.S. Pat. Nos. 3,513,952; 6,026,543; 6,338,400; 6,662,916; and 6,128,806 that are incorporated herein by reference.

Figure 3:
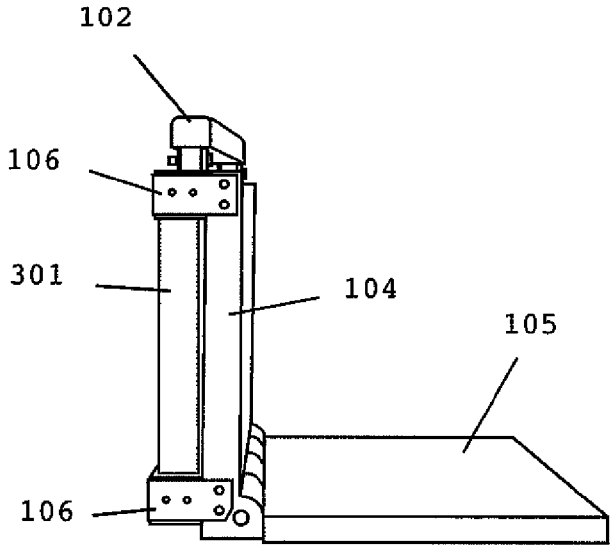
FIG. 3 is a side plan view of an exemplary toe tent device in a lowered position.
Figure 4:
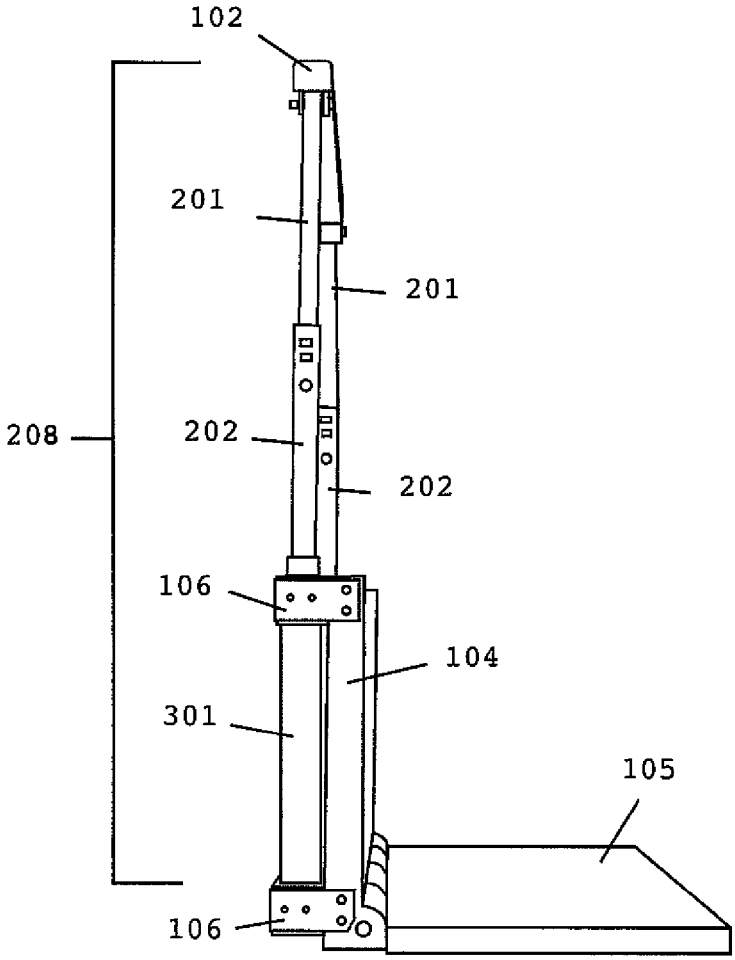
FIG. 4 is a side plan view of an exemplary toe tent device in a raised position.
Figure 5:
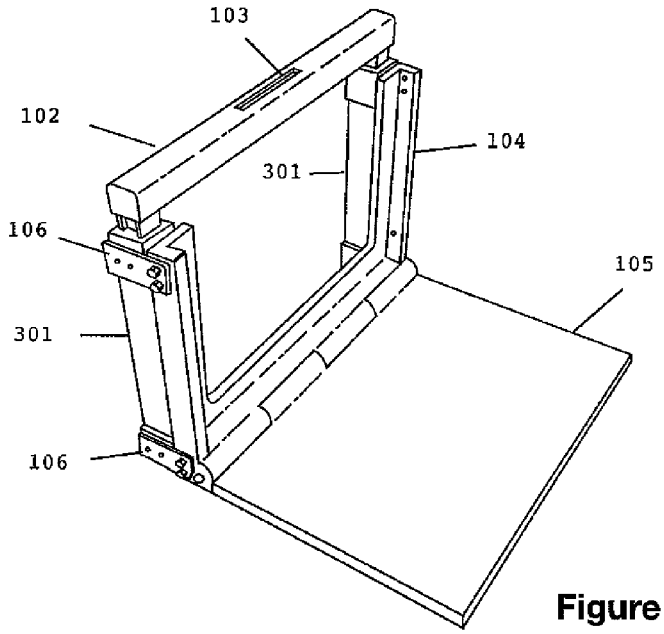
FIG. 5 is a perspective view of an exemplary toe tent device in a lowered position.

FIGS. 3 and 5 display views of an exemplary toe tent device 101 in a lowered position. The support handle 102 is attached to the tops of the upper tubes 201 (see FIGS. 2, 4, and 6), and the upper tubes 201 are slid downward and positioned within the corresponding middle tubes 202 (see FIGS. 2, 4, and 6). The middle tubes 202 are concurrently positioned within the corresponding lower tubes 301. The lower tubes 301 are permanently attached by brackets 106 to the U-shaped support member 104, which is pivotally attached to the base 105.

FIG. 4 displays a side plan view of an exemplary toe tent device 101 in a raised position. The support handle 102 is attached to the top of the upper tubes 201. The bottom of the upper tubes 201 are locked into the top of the corresponding middle tubes 202. The bottom of the middle tubes 202 are locked into the top of the corresponding lower tubes 301. The lower tubes 301 are attached by brackets 106 on either side to the U-shaped support member 104. The U-shaped support member 104 is positioned at approximately a ninety degree angle from the base 105.

Figure 6:
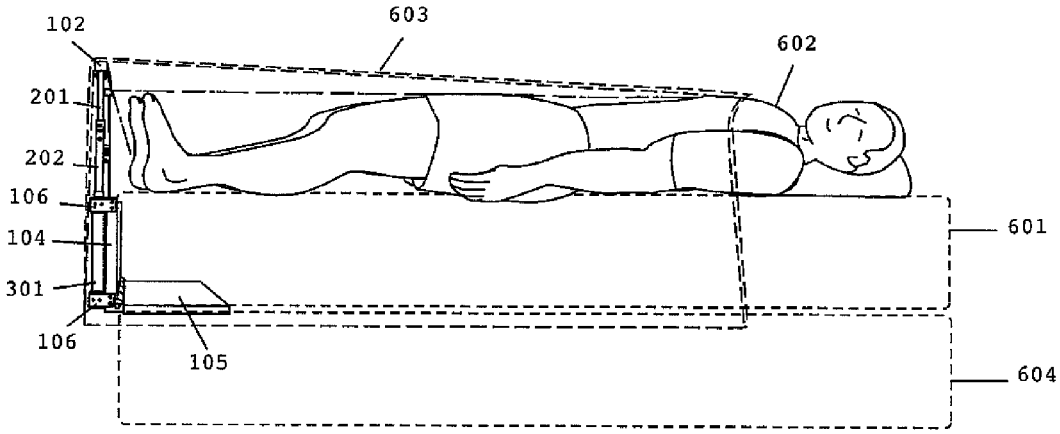
FIG. 6 is a side plan view of a bed, an occupant, covers, and an exemplary toe tent device being used in a raised position.

FIG. 6 shows a side view of a mattress 601, a box spring 605, an occupant 602, bed covers 603, and an exemplary toe tent device 101 in a raised position. The base 105 is positioned between the mattress 601 and box spring 604, and the support handle 102 extends up above the mattress 601 to support the covers 603. The U-shaped support member 104 is positioned vertically at the foot of the mattress 601, and the upper tubes 201, middle tubes 202, and lower tubes 301 are locked into place in order to keep the covers 603 suspended above the toes and feet of the occupant 602. Brackets 106 secure the lower tubes 301 to the U-shaped support member 104.

Figure 7:
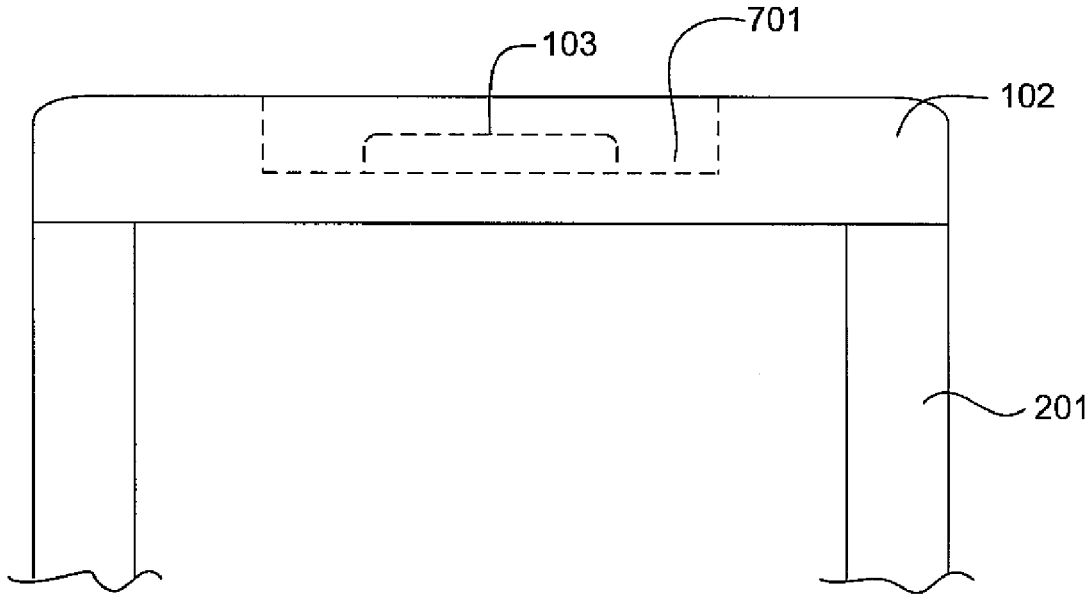
FIG. 7 is a close up view of the handle of the toe tent device with a recessed button.

FIG. 7 shows a close up of the handle 102 and button 103 set within the recess 701 of the handle 102. The recessed button 103 ensures that the weight of the covers will not cause the telescoping support to collapse while the toe tent is in use.

Although a preferred embodiment of the disclosure has been described using specific terms and devices, such description is for illustrative purposes only. The words used are words of description rather than limitation. It is to be understood that changes and variations may be made by those of ordinary skill in the art without departing from the spirit or the scope of the present disclosure, which is set forth in the following claims. In addition, it should be understood that aspects of various other embodiments may be interchanged either in whole or in par. Therefore, the spirit and scope of the appended claims should not be limited to the description of the preferred version contained herein.

I claim:

1. A bed cover supporting device comprising:

a. a base for insertion between a mattress and a box spring; and b. a U-shaped support member comprising a bottom bar and two arms, the bottom bar pivotally attached directly to said base and the two arms of the U-shaped support member coupled to a telescoping support, said telescoping support elevating and supporting said bed covers when said U-shaped support member is pivotally positioned orthogonal to said base when pivotally placed in a raised position.

2. The device of claim 1 wherein said base is positioned horizontally underneath said mattress at the foot of a bed, and said U-shaped support member and said telescoping support extend vertically therefrom when said U-shaped support member is in the raised position.

3. The device of claim 1 wherein said telescoping support is attached to said U-shaped support member by a plurality of brackets.

4. The device of claim 1 wherein said telescoping support further comprises a depressible button for locking and unlocking said support, allowing for the raising and lowering of said telescoping support.

5. The device of claim 4 wherein said depressible button is recessed within said telescoping support.

6. A bed cover supporting device comprising:

a. a base for insertion between a mattress and a box spring;

b. a U-shaped support member comprising a bottom bar and two arms extending from the bottom bar, the bottom bar of the U-shaped member pivotally attached directly to said base, said U-shaped support member adjacent and in contact with said base when said U-shaped support member is in a lowered position;

c. a telescoping support attached to said U-shaped support member, said telescoping support elevating and supporting bed covers when said U-shaped member is in a raised position; and d. a depressible button for locking and unlocking said telescoping support.

7. The device of claim 6 wherein said base is positioned horizontally between a mattress and a box spring at the foot of a bed, and said U-shaped support member and said telescoping support extend vertically therefrom to support said bed covers when said U-shaped member is in said raised position.

8. The device of claim 6 wherein said telescoping support is attached to said U-shaped support member by a plurality of brackets.

9. The device of claim 6 wherein said depressible button is recessed within said telescoping support.

* * * * *